United States Patent [19]

Singh

[11] 4,192,509

[45] Mar. 11, 1980

[54] THREE DIMENSIONAL PUZZLE FIGURE

[76] Inventor: Medilen S. Singh, 208 PCIB Bldg., Greenhills Commercial Center, San Juan Rizal, Philippines

[21] Appl. No.: 873,361

[22] Filed: Jan. 30, 1978

[51] Int. Cl.[2] ..... A63F 9/12

[52] U.S. Cl. ..... 273/157 R

[58] Field of Search ..... 273/157 R; 46/157, 161

[56] References Cited

U.S. PATENT DOCUMENTS

| | | | |
|---|---|---|---|
| 1,324,057 | 12/1919 | Malone | 46/161 |
| 1,437,134 | 11/1922 | Dietrich | 46/161 |
| 1,976,644 | 10/1934 | Gantt | 273/157 R |
| 2,585,419 | 2/1952 | Zarlengo | 273/157 R |
| 2,927,400 | 3/1960 | Bailey | 46/157 |

FOREIGN PATENT DOCUMENTS

| | | | |
|---|---|---|---|
| 1045114 | 6/1953 | France | 273/157 R |
| 2278370 | 2/1976 | France | 273/157 R |

*Primary Examiner*—Anton O. Oechsle

[57] ABSTRACT

Apparatus for constructing a puzzle-like figure on a plane wherein certain parts have boreholes into which rods may be inserted, and onto which additional parts may be movably fitted, so as to construct a three-dimensional figure having interlocking parts and movable parts.

4 Claims, 5 Drawing Figures

THREE DIMENSIONAL PUZZLE FIGURE

BACKGROUND OF THE INVENTION

The invention refers to a game of composition, consisting of individual equally strong and platelike parts, that may be connected together, and are made of wood or plastic.

It is known as a so-called composition game, in which a platelike image can be created of individual, platelike single formfitted pieces, the single parts being coated with picture segments, resulting in an entire picture upon completing the composition.

The formfitting parts are put together as a plate on a base.

Furthermore, it is known to create single shapes like animal figures, etc., of different materials like cardboard for instance, or similar materials; it is also possible to stand these figures up under certain conditions.

The invention intends to create a game of composition where certain shapes can be put together by joining together single parts, which then are able to stand upright. The task is thus solved, that according to the invention the individual parts exist of a head part, a torso part and a pelvis part, formfitting into a human or animal shape on one plane, where at least one torso or pelvis part is provided with a borehole or the like into which fits a rod which is perpendicular to this plane; and that onto this rod equally strong leg- and/or arm-parts are movably attached, warranting the stability of the figure.

The puzzle-like, joinable figures can be formfitted under a minimum of single parts, where, by exchanging a few parts other figures can be created.

SUMMARY OF THE INVENTION

According to a preferred design of the invention, at least two torso parts and one pelvis part are intended, of which two parts are provided with a borehole or such each, for the fitting of the little rod. Normally leg- or arm-parts are movably attached in pairs to these rods or such. At least one torso part showing a borehole or such, can be formed mirror image like referring to a perpendicular plane, cutting the borehole plane. Also a tailpart can be formfitted with the pelvis part. The head part can show a groove, an incision or the like on its upper edge, into which a part, running perpendicularly to the figure plane can be mounted, indicating ears, mane or the like of the figure; also it is possible that at least one leg or armpart is provided with a borehole or notch or such, into which another shield-shaped part for instance can be movably inserted. Two leg- or arm-parts, attachable to a rod or such, can be formed differently.

DESCRIPTION OF THE DRAWINGS

Examples of the invention are illustrated on the drawings, in which.

DESCRIPTION OF THE PREFERRED EMBODIMENT

Figure 1:
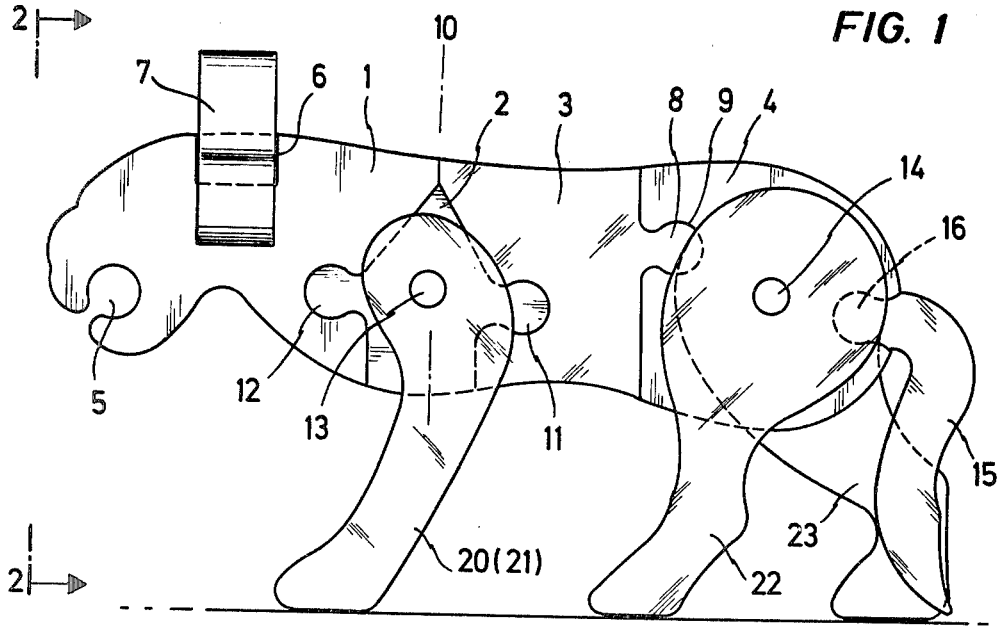
FIG. 1 is a side view of an animal embodiment of the invention.

The design example according to FIG. 1 is developed from a strongly stylized illustration of an animal, which shows one head part 1, two torso parts, 2, 3 and a pelvis part 4. The head part has a notch 5, indicating the mouth of the animal and a right angle groove 6, into which another part can be mounted, as further described below.

The parts 1–4 placed in one plane are consistently equally strong and are formfitted, for example, by protrusions 8 in corresponding notches 9 of adjacent parts; it is apparent that individual parts can be separated by shifting perpendicularly to the drawing direction.

The single parts are preferably made of wood with a thickness of approximately 7–15 mm and are of any convenient size, for example the size shown on the drawing.

The torso part 2 is constructed in mirror image with reference to a plane 10; i.e. it shows protrusions 11, 12 that are fitted according to the notches of the adjacent parts.

The torso part 2 shows a borehole 13, the significance of which is described further below.

Also, the pelvis part 4 shows a borehole 14. A tailpart 15 with its protrusion 16 is formfitted with the pelvis part notched accordingly.

All mentioned parts are equally strongly formed and proceed in one plane with a production of the composition game in wood, for instance, the single parts can be easily and simply manufactured; the interchangeability of the individual parts, which naturally can also have different outlines, is also warranted to a limited extent.

Rods which are nearly three times as long as the thickness of an individual part 1 to 4, are inserted in the boreholes 13, in the torso part 2 and 14, and in the pelvis part 4. The ends of the rods which stick out on both sides carry movable leg parts 20 and 21 respectively. These leg parts are each shaped the same way; the leg parts 22 and 23, however, have different contours.

Since the leg parts have the same thickness as the individual parts 1 to 4, however, in contrast to the latter are movable with or around the rods, an exchange of the leg parts among each other is possible without difficulty, also concerning the individual sides of the main torso.

With that the child's urge to play can be satisfied not only concerning the form of the individual figures; the child's urge to play can furthermore be stimulated, as the child learns how a body is put together by exchanging individual parts of human or animal figures.

Figure 2:
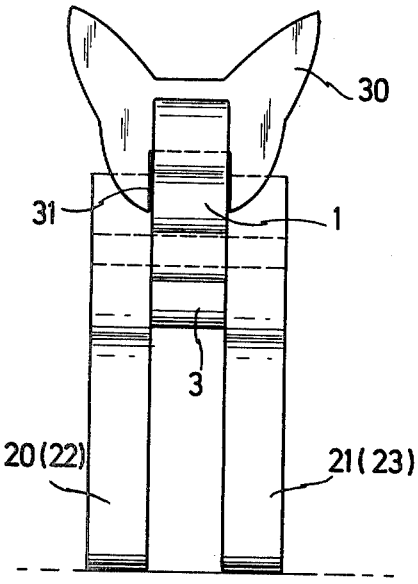
FIG. 2 is a view according to line 2—2 in FIG. 1.

In FIG. 2 which is a front view of the figure in FIG. 1, a top part 30 is mounted on the head part 1, which itself shows an incision 31 which is the right width for the insertion of the individual parts, and with that, as is evident from FIGS. 1 and 2, can be mounted on the head part 1.

The entire animal figure consists in the described embodiment of only 10 individual parts, not counting the two rods.

Figure 3:
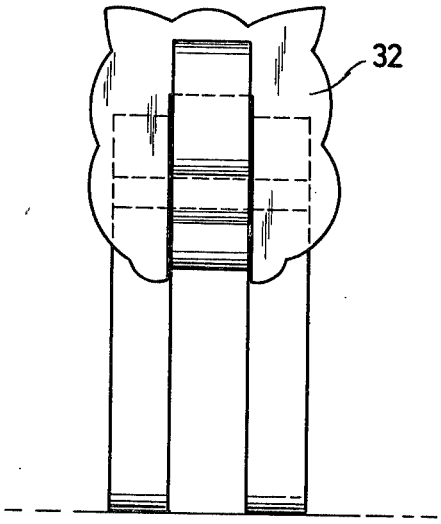
FIG. 3 is a view similar to FIG. 2 on an altered embodiment.

As is evident from FIG. 3, another part 32 can be easily mounted on the same place on the head part 1 instead of the mounted part 30, so that this results in another figure which, for example, in the case of FIG. 3 resembles a lion.

Figure 4:
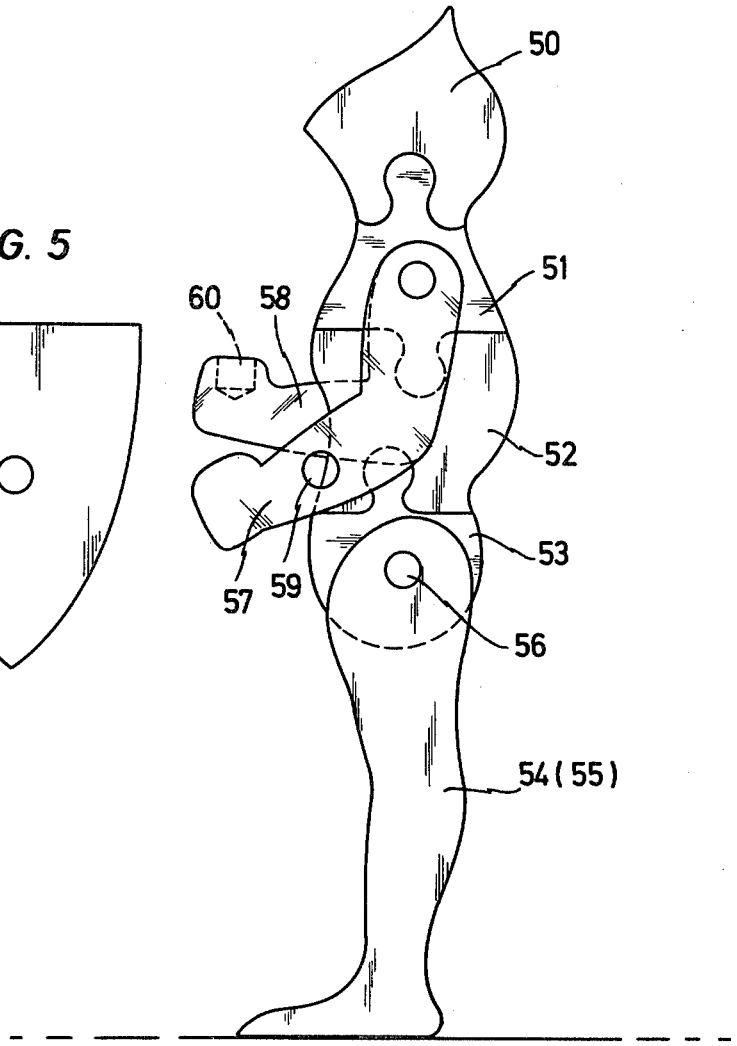
FIG. 4 is a side view of another embodiment or design of the invention.
Figure 5:
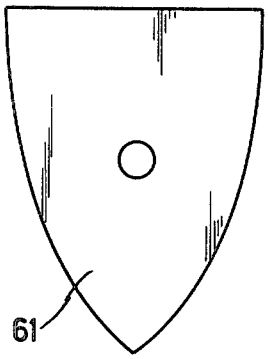
FIG. 5 is a detail for the design according to FIG. 4.

Also with the form of a human- or knight-like shape, as presented in FIG. 4, only a minimum of individual parts is provided for the assembling of the figure. Besides the head part 50, two torso parts 51, 52, and the pelvis part 53, two legs parts 54 and 55 are provided, which again are movably held in the pelvis part. Furthermore, two differently formed arm parts 57 and 58 are provided. While the arm part 57 is at an obtuse angle and shows a borehole 59, the arm part 58 has on its free end a borehole 60 which lies in the drawing-plane.

While the borehole 60 can, for example, take a sword part or the like, one can, for example, mount movably in the borehole 59 a shield part 61, by means of a rod.

It is therefore apparent that the basis of the invention is to provide figures consisting of parts that are formfitting connected with each other in one plane, while the extremities each are movable in two other planes and enhance the stability of the figure. Above all, the extremities are easily exchangeable; it is, however, obvious that, for example, instead of the head part 50 another head part can be used, or that instead of the two torso parts 51, 52, only one torso part can be used.

What is claimed is:

1. A puzzle figure comprising a plurality of equally thick, plate-like and partly exchangeable parts, the body thereof consisting of at least one exchangeable head part, two torso parts and one pelvis part which are formfittingly interconnected on one plane, and wherein said pelvis part and one of said torso parts respectively is provided with a borehole perpendicular to the plane of said figure and said one torso part is formed as a mirror image about a perpendicular plane through said borehole; rods sized for insertion through said boreholes, each of said rods having a length greater than the thickness of said head, torso and pelvis parts; and leg parts movably attachable on said rods, said leg parts being of equal thickness to said head, torso and pelvis parts.

2. The puzzle figure of claim 1 further comprising an exchangeable tail part formfittingly connected with the pelvis part.

3. The puzzle figure of claim 1 wherein said head part further comprises a notch; and further comprising a notched part interconnectable with said head part notch perpendicularly to the figure plane.

4. The puzzle figure of claim 1 wherein said leg parts are formed to have respectively different shapes from each other.

* * * * *